US010823419B2

(12) United States Patent
Jones et al.

(10) Patent No.: US 10,823,419 B2
(45) Date of Patent: Nov. 3, 2020

(54) COMBUSTION SYSTEM WITH DEFLECTOR

(71) Applicant: General Electric Company, Schenectady, NY (US)

(72) Inventors: Ryan Christopher Jones, West Chester, OH (US); Scott Matthew Bush, West Chester, OH (US); Paul Christopher Schilling, West Chester, OH (US); Andrew Scott Bilse, West Chester, OH (US)

(73) Assignee: General Electric Company, Schenectady, NY (US)

( * ) Notice: Subject to any disclaimer, the term of this patent is extended or adjusted under 35 U.S.C. 154(b) by 276 days.

(21) Appl. No.: 15/909,106

(22) Filed: Mar. 1, 2018

(65) Prior Publication Data

US 2019/0271469 A1 Sep. 5, 2019

(51) Int. Cl.

| | |
|---|---|
| ***F23R 3/16*** | (2006.01) |
| ***F23R 3/60*** | (2006.01) |
| ***F23R 3/50*** | (2006.01) |

(52) U.S. Cl.

CPC ..... *F23R 3/16* (2013.01); *F23R 3/50* (2013.01); *F23R 3/60* (2013.01)

(58) Field of Classification Search

CPC .... F23R 3/002; F23R 3/60; F23R 3/50; F23R 3/14; F23R 3/04; F23R 3/10; F23R 3/20; F23R 2900/00017; F23R 3/007

See application file for complete search history.

(56) References Cited

U.S. PATENT DOCUMENTS

| | | | | |
|---|---|---|---|---|
| 4,916,905 | A * | 4/1990 | Havercroft | F23R 3/002 60/756 |
| 5,353,587 | A * | 10/1994 | Halila | F23R 3/002 60/39.37 |
| 8,061,142 | B2 | 11/2011 | Kastrup et al. | |
| 8,171,734 | B2 | 5/2012 | McMasters et al. | |
| 8,893,382 | B2 * | 11/2014 | Patterson | F23R 3/002 29/889.2 |
| 9,046,272 | B2 * | 6/2015 | Rice | F23R 3/60 |
| 9,126,210 | B1 | 9/2015 | Acharya | |
| 10,533,437 | B2 * | 1/2020 | Dale | F23R 3/04 |
| 2002/0038549 | A1 * | 4/2002 | Ebel | F23R 3/10 60/748 |
| 2008/0083841 | A1 * | 4/2008 | Bainville | F02C 7/22 239/419.3 |
| 2016/0201918 | A1 | 7/2016 | Jella et al. | |

(Continued)

*Primary Examiner* — Scott J Walthour
*Assistant Examiner* — Todd N Jordan
(74) *Attorney, Agent, or Firm* — General Electric; Pamela Kachur

(57) ABSTRACT

The present subject matter provides a combustion system which comprising: a cowl; a deflector configurated to include a ring body, a plurality of swirlers integrated on the ring body and a plurality of arms integrally extending outward from the ring body; an annular inner liner attached with the cowl; and an annular outer liner attached with the cowl. The deflector is positioned between the inner liner and the outer liner; the deflector, the inner liner and the outer line define a combustion chamber thereamong. The deflector is attached to the cowl via the plurality of arms, but the arms are rigid enough to work together to fix the deflector with the cowl while allowing for thermal expansion flexibility therebetween at the same time.

17 Claims, 11 Drawing Sheets

(56) References Cited

U.S. PATENT DOCUMENTS

| | | | |
|---|---|---|---|
| 2016/0230997 | A1 | 8/2016 | Donovan et al. |
| 2016/0376997 | A1 | 12/2016 | Prociw |
| 2017/0130652 | A1 | 5/2017 | Siders et al. |
| 2017/0205070 | A1 | 7/2017 | Ryon |
| 2017/0234538 | A1 | 8/2017 | Park et al. |

* cited by examiner

COMBUSTION SYSTEM WITH DEFLECTOR

FIELD OF THE INVENTION

The subject matter disclosed herein relates to a combustion system, and more particularly, a combustion system with a unique deflector.

BACKGROUND OF THE INVENTION

Turbine engines, such as those used to power modern commercial aircraft, include a compressor for pressurizing a supply of air, a combustor for burning a hydrocarbon fuel in the presence of the pressurized air, and a turbine for extracting energy from the resultant combustion gases. In many aircraft engine applications, the compressor, combustor and turbine are disposed about a central engine axis with the compressor disposed axially upstream of the combustor and the turbine disposed axially downstream of the combustor.

It has become increasingly desirable to increase the efficiency and reduce the size of turbine engines. Such turbine engines typically include one or more shafts that include compressors, bypass fans, and turbines. Typically, air is forced into the engine and passed into a compressor. The compressed air is passed to a combustor, and at high temperature and pressure the combustion products are passed into a turbine. The turbine provides power to the shaft, which in turn provides the power to the compressor and fan or gearbox. Thrust is thereby produced from the air that passes from the fan, as well as from the thrust expended in the turbine combustion products. This system is typically packaged together with power production and thrust generation co-located.

Combustors for turbine engines typically have a wall with a plurality of air holes, such as cooling or dilution holes, for admitting compressed air into the combustor. In an annular combustor, outer and inner walls cooperate to define, and are separated by, an annular combustion chamber.

An annular combustor may further have a bulkhead, which may be segmented into panels in some combustor designs, at a forward end of the combustor and extending from the outer wall to the inner wall. At least one fuel nozzle extends through this bulkhead and into the combustion chamber to release the fuel. A swirler is generally positioned around each fuel injector to admit combustion air, create turbulence in the combustion air, and mix the combustion air and the fuel before the mixture is combusted.

One prior combustion system may comprise an outer cowl, an inner cowl, a combustor dome attached to the outer cowl and the inner cowl, an outer wall, an inner wall, and a combustor space defined by the outer wall, the inner wall and the combustion dome. The combustor dome has an outer dome ring, an inner dome ring, a plurality of nozzle components positioned between the inner dome ring and the outer dome ring, and the ring-like fuel manifold formed with the outer dome ring.

However, the combustion system of this prior design as above have many separate components which makes them expensive and complex to prepare and assemble them into the combustion system. Another shortcoming of this prior art is that the combustion system can only be assembled into the engine case from an aft position of the engine case, i.e., in an aft-mounted way.

Another prior art design is shown in FIG. 1. It is also an aft-mounted type of annular combustor. This prior combustor comprises an annular cowl 11, an annular dome 12, a plurality of annular swirler 14, a deflector ring 13, an annular inner liner 15 and an annular outer liner 16. One end of the cowl 11 is integrally formed with an end of the dome 12 and an upstream end of the outer liner 16, while the other free end of the cowl 11, the other free end of the dome 12 and an upstream end of the inner liner 15 are fixed together via a fastener. A combustion chamber 150 is defined by the inner liner 15, the outer liner 16 and the deflector ring 13. Each of the swirlers 14 engages within a corresponding channel defined in the deflector ring 13 such that fuel can pass therethrough and enter the combustion chamber 150. The combustor is mounted to a case 1 of an engine, where the combustor is used, and inner structures 10 via mounting legs 17 by fasteners (not labeled). Compressed air flows into the interior space 19 along a direction as indicated by an arrow A' from a diffuser 18 and then enters into the combustion chamber 150 for combustion therein.

Such a prior art as shown in FIG. 1 share similar shortcomings with that of the prior design as discussed above. Specifically, the structure of the combustor is rather complicated with so many separate components which make it inefficient and expensive to manufacture such a combustor.

Furthermore, in the prior design in FIG. 1, one end of the cowl 11 is integrally formed with an end of the dome 12 and an upstream end of the outer liner 16, while the other free end of the cowl 11, the other free end of the dome 12 and an upstream end of the inner liner 15 are fixed together via a fastener. Such a configuration enables it physically very secured, but will make it uneasy to absorb thermal deformation of the fixed components since all components of the combustor will inevitably suffer high temperature and pressure. As a possible result, such prior design is prone to damage due to thermal expansions thereof.

Therefore, when utilized in conjunction with aircraft, space and weight are at a premium and the engines must be as light and compact as possible. It would be desirable to reduce component size and complexity of an aero engine without sacrifice of system performance thereof.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a combustion system is provided to comprise: a cowl; a deflector configurated to include a ring body and a plurality of arms integrally extending outward from the ring body; an annular inner liner attached with the cowl; an annular outer liner attached with the cowl; wherein the deflector is positioned between the inner liner and the outer liner; the deflector, the inner liner and the outer liner define a combustion chamber therebetween; and wherein the deflector is attached to the cowl via the plurality of arms which are rigid enough to fix the deflector with the cowl while allowing for thermal expansion flexibility therebetween at the same time.

The deflector further comprises a plurality of swirlers integrated with the ring body on a same side of ring body with the plurality of arms. Each of the plurality of arms is L-shaped, and has an arm extension extending from the ring body and a mounting face angled from the arm extension, and wherein the mounting face defines an aperture for a fastener therethrough to fix the arm with the cowl. The deflector is positioned between an upstream end of the inner liner and an upstream end of the outer liner, and wherein edges of the ring body abut ends of the cowl, inner surface of the upstream end of the inner liner and inner surface of the upstream end of the outer liner.

The cowl is annular and has a dome-like cross section, and wherein the cowl is attached to and between the upstream end of the inner line and the upstream end of the outer liner. The cowl is fixed to a case of an engine through one or more mounting arm, and the one or more mounting arm extends forward in an upstream direction for enabling the combustion system to be assembled within the case in a forward mounting way.

A fuel nozzle enters through the cowl and an end of the fuel nozzle aligns with a corresponding swirler of the deflector such that corresponding fuel flow into the swirler and a space between the cowl and the deflector before into the combustion chamber. The combustion system further comprises a ferrule for attaining the end of the fuel nozzle with the corresponding swirler of the deflector.

In a second embodiment, a combustion system is provided to comprise: a cowl; a deflector configurated to include a ring body, a plurality of swirlers and a plurality of arms; an annular inner liner attached with the cowl; an annular outer liner attached with the cowl; wherein the plurality of swirlers and the plurality of arms are integrated on the ring body, the deflector is positioned between the inner liner and the outer liner thereby defining a combustion chamber thereamong, and wherein the deflector is attached to the cowl via the plurality of arms.

The plurality of swirlers are integrated with the ring body on a same side of ring body with the plurality of arms. Each of the plurality of arms is L-shaped, and has an arm extension extending from the ring body and a mounting face angled from the arm extension, and wherein the mounting face defines an aperture for a fastener therethrough to fix the arm with the cowl. The deflector is positioned between an upstream end of the inner liner and an upstream end of the outer liner, and wherein edges of the ring body abut end walls of the cowl, inner surface of the upstream end of the inner liner and inner surface of the upstream end of the outer liner.

The cowl is annular and has a dome-like cross section, and wherein the cowl is attached to and between the upstream end of the inner line and the upstream end of the outer liner. The cowl is fixed to a case of an engine through one or more mounting arm, and the one or more mounting arm extends forward in an upstream direction for enabling the combustion system to be assembled within the case in a forward mounting way.

A fuel nozzle enters through the cowl and an end of the fuel nozzle engages with a corresponding swirler of the deflector for delivering a fuel flow via the deflector into the combustion chamber.

In a third embodiment, an engine system is provided to comprise: a case; a fuel nozzle; and a combustor assembly (system). The combustor assembly (system) includes: an annular cowl; a deflector configurated to include a ring body and a plurality of arms integrally extending outward from the ring body; an annular inner liner attached with the cowl; and an annular outer liner attached with the cowl. The deflector is positioned between the inner liner and the outer liner; the deflector, the inner liner and the outer liner define a combustion chamber thereamong. The deflector is attached to the cowl via the plurality of arms which are rigid enough to fix the deflector with the cowl while allowing for thermal expansion flexibility therebetween at the same time.

The present subject matter provides a combustion system employing a one-piece deflector (dome) with integrally formed swirlers that covers the entire annulus of an annular combustor. The function is to protect related structural components from high combustion gas temperatures and hold the swirlers in place during assembly and operation. The deflector is attached to the cowl via a plurality of relatively weak arms so that it is free to expand as thermal loads driven into the device. The deflector typically has minimal mounting features and is printed as one piece with the swirlers. Additionally, the deflector may have holes printed into the surface that faces the combustor flame.

The assembly/fixing mechanism between the deflector and the cowl without additional dome (compared with the prior arts), which is a design simpler, lighter and cost-saving compared with the prior arts. And more importantly, the weakness of the arms allows for thermal expansion while the arms keep the combination of the whole structure stiff enough to withstand vibrational stresses.

Another advantageous technical effect of the present subject matter is that the ring body, the swirlers and the (weak) arms are integrated into the deflector as one single piece, which is simpler, lighter and cost-saving compared with the prior arts with separate ring, swirlers and deflectors.

Further, the present subject matter gives a forward mounting structure of the combustion system (combustor) with forwardly extending mounting arms fixed to the engine's case via fasteners, which makes the combustor/combustion system having a stronger capability against various vibrations.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION OF THE INVENTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In the following specification and the claims, reference will be made to a number of terms, which shall be defined to have the following meanings.

When introducing elements of various embodiments of the present subject matter, the articles "a," "an," "the," and "the" are intended to mean that there are one or more of the elements. The terms "comprise/comprising," "include/including," and "have/having" are intended to be inclusive and mean that there may be additional elements other than the listed elements.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

The present subject matter can be applied to any annular combustor. A solution in accordance with the present subject matter provides advantages in the areas of part count, assembly, and durability. The solution combines the functionality of deflector/dome segments and positioning of the swirler. This means that there is no need for a combustor dome if structural loads are directed through liners, cowls or other components.

Figure 1:
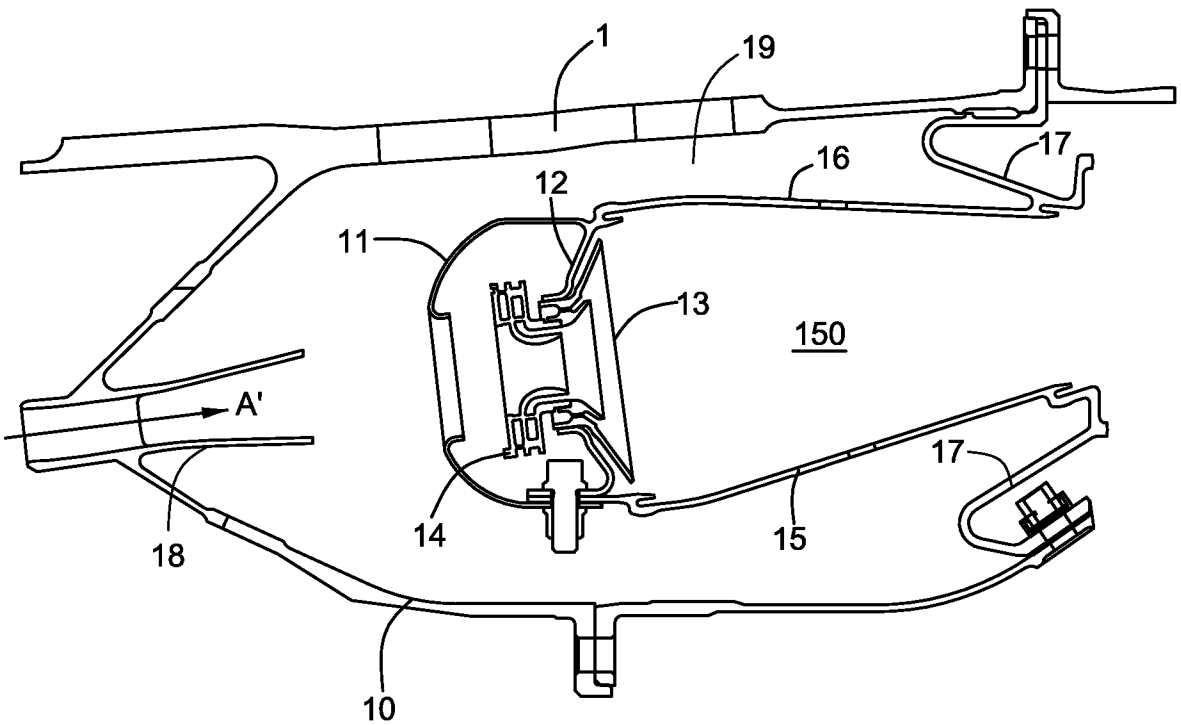
FIG. 1 (Prior Art)
FIG. 1 is a schematic view of a prior art engine having a combustion system.
Figure 2:
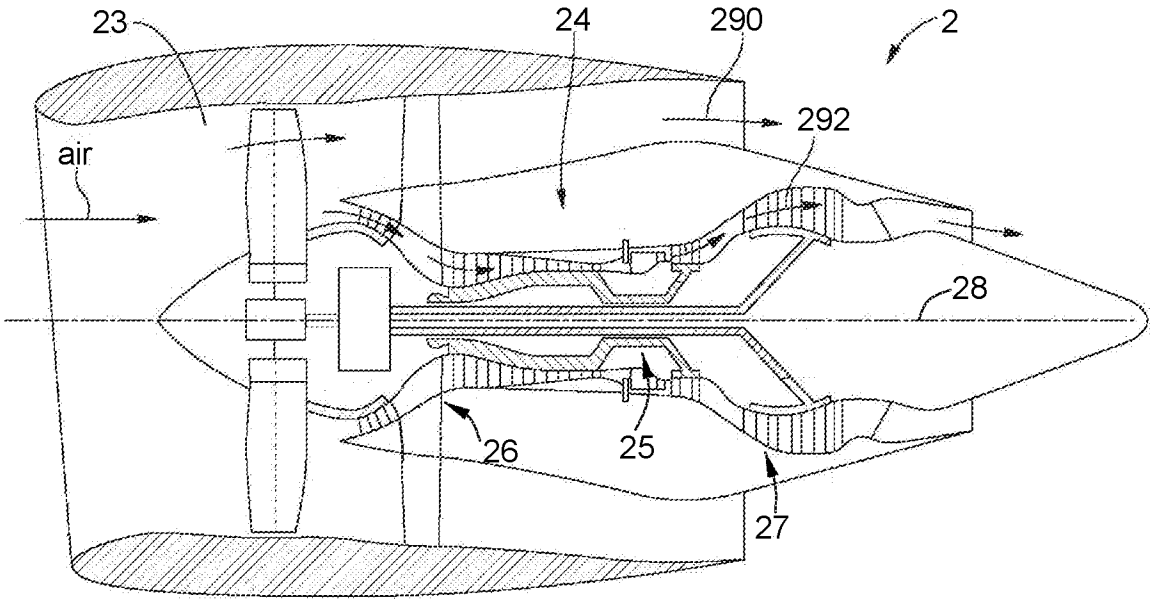
FIG. 2 is a schematic cross-sectional view of an exemplary engine according to various embodiments of the present subject matter.

Now referring to FIG. 2, an exemplary engine or engine system 2 is shown in accordance with the present subject matter. The engine 2 shown in FIG. 2 is just an exemplary one and may be any other suitable configurations when applicable. The engine 2 can be used for aircraft applications or any other possible application purposes. The engine 2 comprises a core turbine engine 24 received within an interior space 23 thereof. The core turbine engine 24 normally comprises a compressor section 26, a combustor section 25 and a turbine section 27. When air enters the interior space 23, it is divided into two portions. One portion of the air flows along a bypass airflow passage 290 surrounding the core turbine engine 24, while the other portion of the air flows into the core turbine engine 24 and will be in a combustion reaction with fuel in the combustor section 25. Combustion gases produced by the reaction then flow out of the combustor section 25 along a combustion gas flow path 292.

Figure 3:
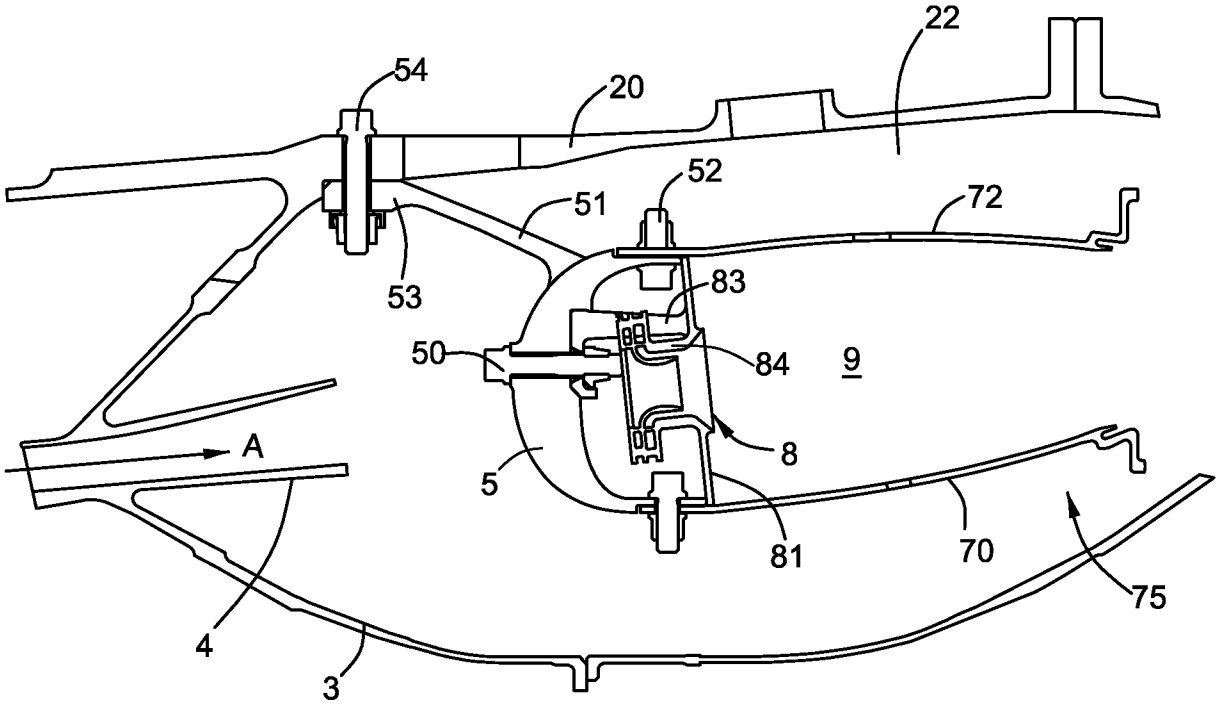
FIG. 3 is a schematic view of an embodiment of a combustor-case assembly of an engine illustrating the present subject matter.
Figure 4:
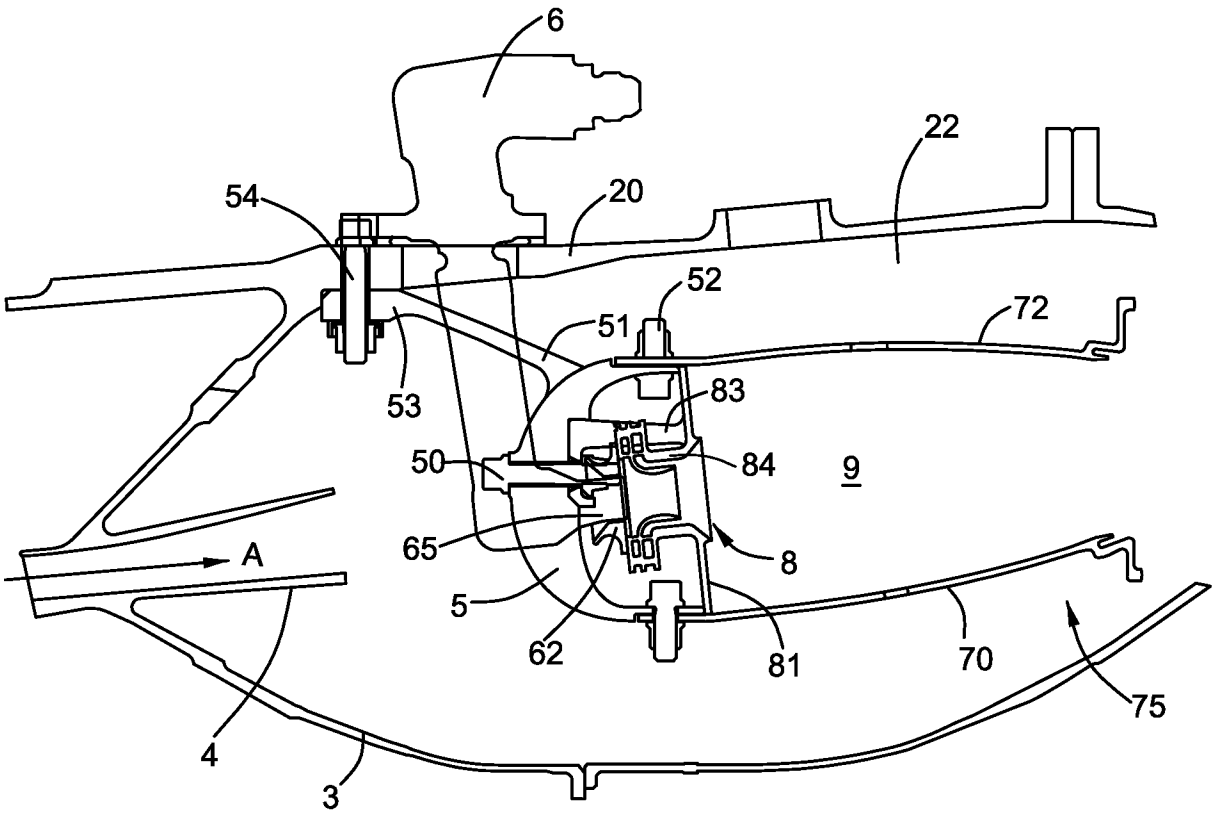
FIG. 4 is a schematic view of an embodiment of a combustor-case assembly of an engine illustrating the present subject matter with a fuel nozzle attached thereto.
Figure 5:
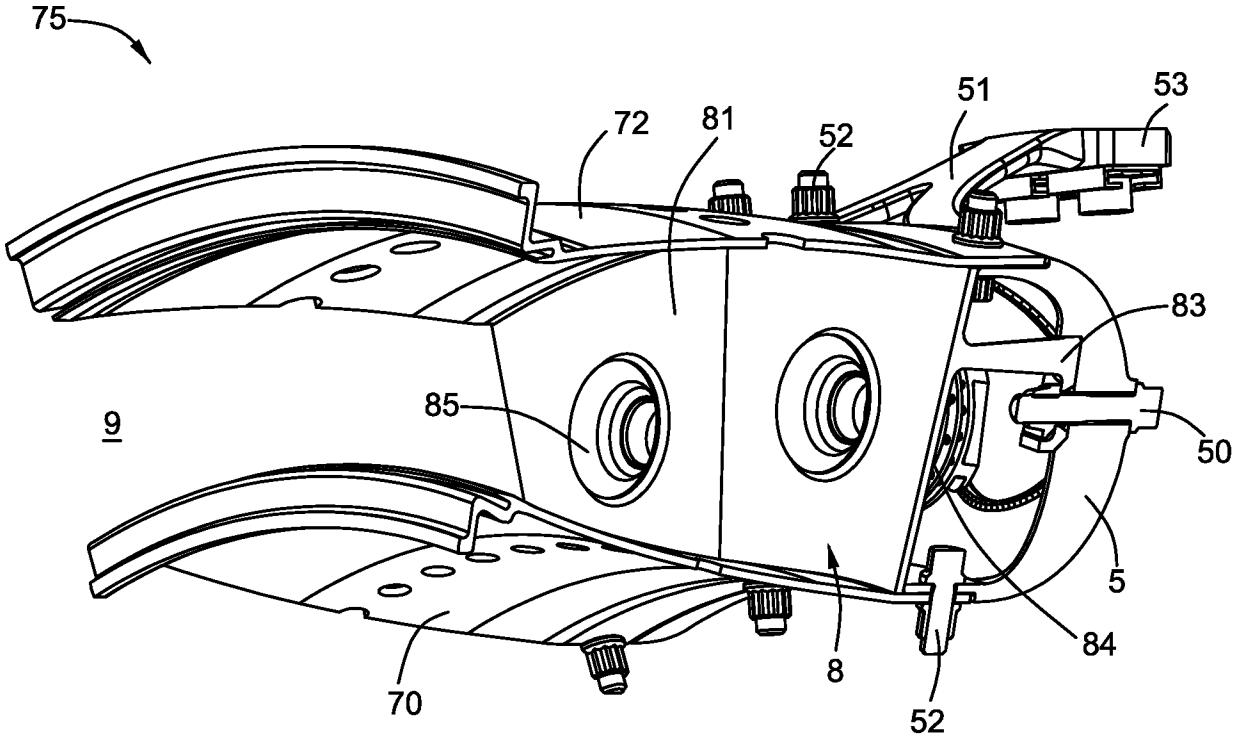
FIG. 5 is a perspective view of an embodiment of a combustion system in FIG. 3 in accordance with the present subject matter.
Figure 6:
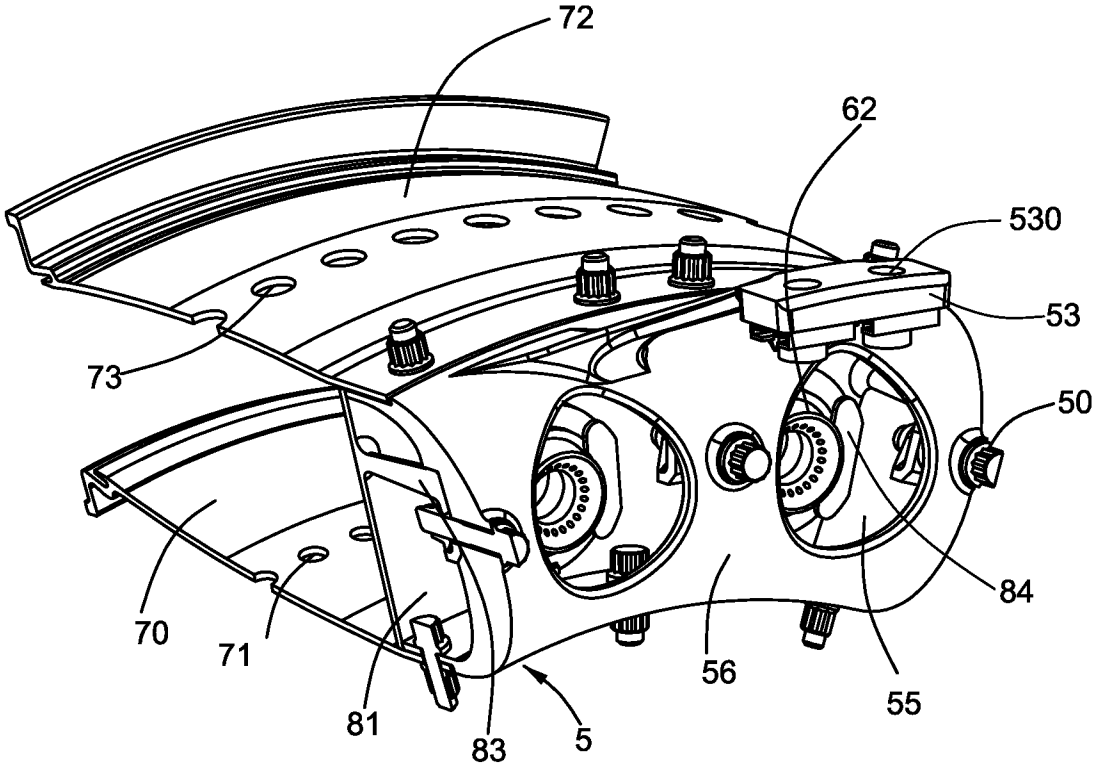
FIG. 6 is another perspective view of the combustion system in FIG. 3 in accordance with the present subject matter.
Figure 7:
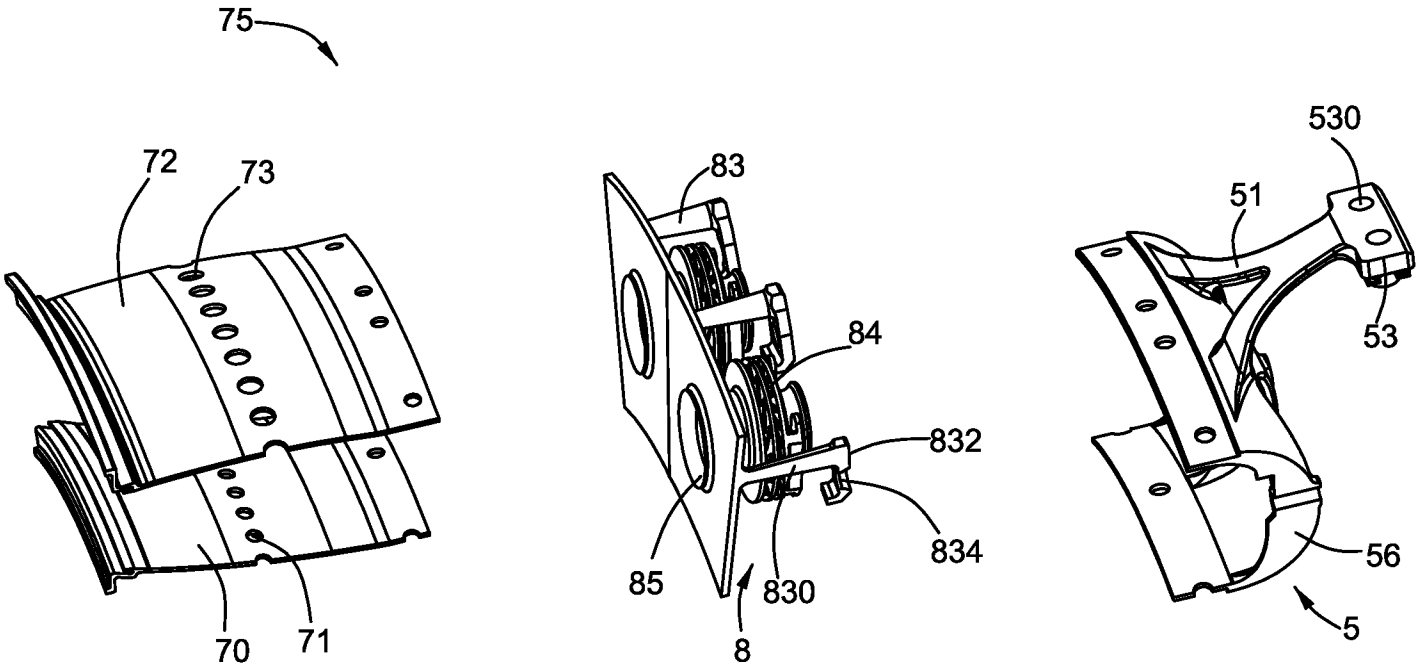
FIG. 7 is an explosive view of the combustion system in FIG. 3 in accordance with the present subject matter.
Figure 8:
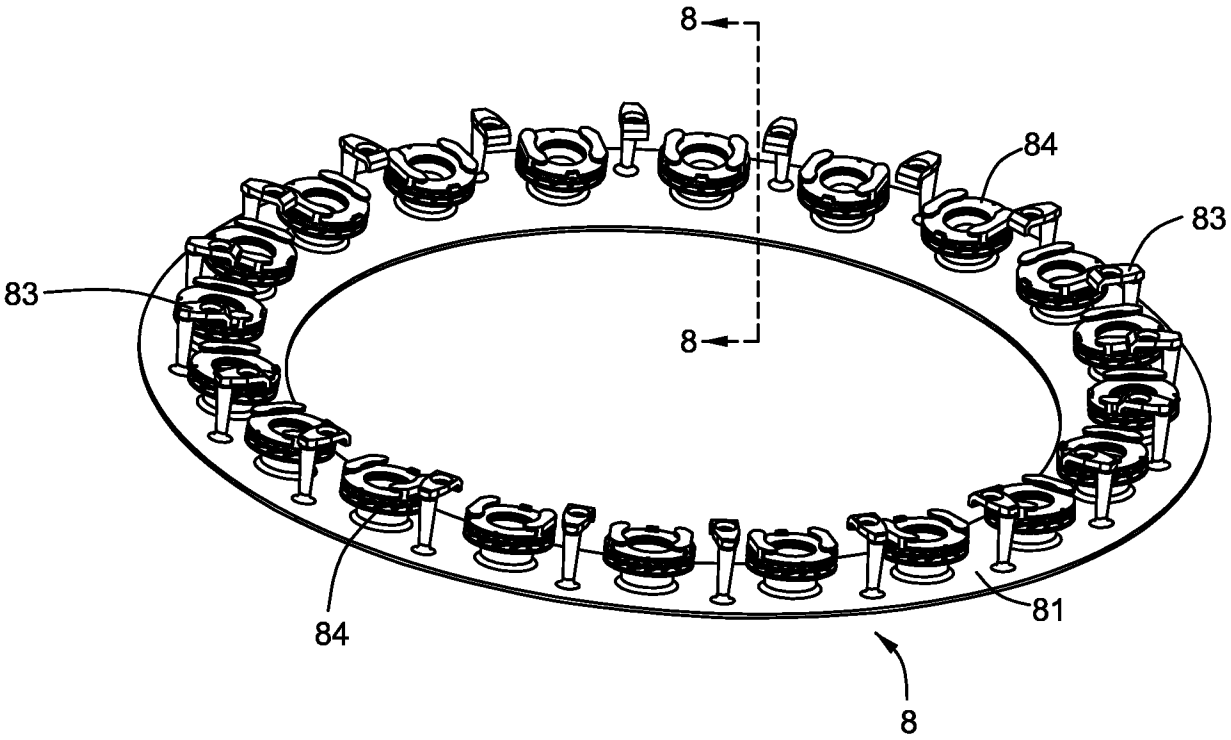
FIG. 8 is a perspective view of a one-piece deflector of the combustion system in FIG. 3.

With reference to FIGS. 3-4 show a combustor-case assembly of the engine 2. The assembly comprises a case 20, a combustion assembly/system (hereinafter referred to be "combustor") 75, and inner structures 3. The combustor 75 is annularly positioned within the case 20 and in an annular interior chamber 22 between the case 20 and the inner structures 3. The case 20 can have any suitable shape or size and can be made of any suitable materials. The interior chamber 22 may have any shape or size which allows the combustor 75 normally workable therein. Also, the combustor 75 may be located at any suitable position in the space relative to the case 20 and/or the inner structures 3.

A fuel nozzle 6 is fixed onto the case 20 (FIG. 4) and at the same time enters through a corresponding slot (not labelled) defined in the case 20 from outside into the interior chamber 22. An injection end 65 of the fuel nozzle 6 engages with a corresponding swirler 84 and a ferrule 62 is disposed to abut a forward surface 88 (FIGS. 4 and 10-11) of the swirler 84 so as to help attain the injection end 65 of the fuel nozzle 6 with the swirler 84. Optionally, the ferrule 62 may be omitted. It will be understood that the fuel nozzle 6 and/or the ferrule 62 may have any configurations adaptable for realizing an aimed function of delivering fuel into the combustor 75. Though types of the fuel would not be a limitation to the present subject matter, liquid or gas fuel would be preferable options.

A diffuser 4 is located at an upstream position relative to the combustor 75. Compressed air coming from a compressor flow through the diffuser 4 in a direction as indicated in arrow A into the chamber 22 between the case 20 and the inner structures 3. The compressed air may then flow into the combustor 75 for combustion.

With references to FIGS. 3-11, the combustor 75 includes a cowl 5, a one-piece deflector 8, an inner liner 70 and an outer liner 72. The inner liner 70, the outer liner 72 and the deflector 8 define a combustion chamber 9 thereamong. The combustor 75, the cowl 5, the deflector 8, and the inner and outer liners 70/72 are all annular and the drawings herewith are side views only showing them partially and schematically. It shall be understood that the combustor 75, the case 20 and/or the inner structures 3 are configured to surround a longitudinal axis 28 of the engine 2 (FIG. 2).

As better shown in FIGS. 3-6 (partial), the combustor 75 in accordance with the present subject matter only has four components including the cowl 5, the one-piece deflector 8, the inner liner 70 and the outer liner 72. As compared with the prior arts discussed above, the combustor 75 enjoys advantages of being simpler, lighter and thus cost saving.

The cowl 5 is annular and has a dome-like cross section. A plurality of apertures 55 are defined in an annular dome-like portion 56 of the cowl 5. The apertures are adapted to receive the injection end 65 of the fuel nozzle 6 therethrough and also allow some of the compressed air to pass through and go into the combustor 5. A plurality of mounting arms 51 extend outwardly and forwardly from the dome-like portion 56. Each mounting arm 51 has a mounting portion 53 at an end of the mounting arm 51 away from the dome-like portion 56. The mounting portion 53 may be a square plate like a platform, however, it can have any shape or configuration which enables it to fulfill its function. A hole 530 is defined in the mounting portion 53 for accommodating a fastener 54 (as in FIG. 2). Thus, the plurality of the mounting arms 51 can fix the cowl 5 firmly to the case 20 of the engine 2 via the fasteners 54. In one embodiment, the fasteners 54 may be bolts. The fasteners 54 may be nuts, screws, or any other suitable means with same functions here.

As clearly shown in FIGS. 3 and 4, the mounting arms 51 extend outward from the dome-like portion 56 of the cowl 5 to forward or ahead positions for being fixed with the case 20 relative to the combustor 75. In other words, the combustor 75 is a forward mounting structure with forwardly extending mounting arms attached to the engine's case via bolts or other fasteners, which makes the combustor 75 to have a strong capability against various vibrations. Optionally, the mounting arms 51 may be attached to the case 20 by other means like welding, brazing, etc.

It is well known that, in an engine, there would be various types of vibrations such as rotor/fan vibrations, aircraft/wing vibrations, vibrations caused by compressor blade passing frequencies, combustor acoustic vibrations, and engine system vibrations, etc. Because most of the weight of the combustor 75 focuses at an upstream end of the combustor 75, the forward mounting structure of the combustor 75 will definitely be more steady and firmer to resist possible strong vibrations as compared to the aft-mounted type of annular combustors in the prior arts discussed above.

Further refer to FIGS. 5-9, the deflector 8 comprises a ring body 81, a plurality of swirlers 84 integrally formed on a surface 87, and a plurality of arms 83 integrally extending outward from the surface 87. In one embodiment, the arms 83 and the swirlers 84 are aligned side by side alternatively on the same surface 87 of the ring body 81. However, there could be other possible arrangement of the swirlers 84 and the arms 83. The ring body 81 may be a flat ring and the surface 87 has a width sufficient for arranging the arms 83 and the swirlers 84 thereon (see FIG. 8-9).

Figure 9:
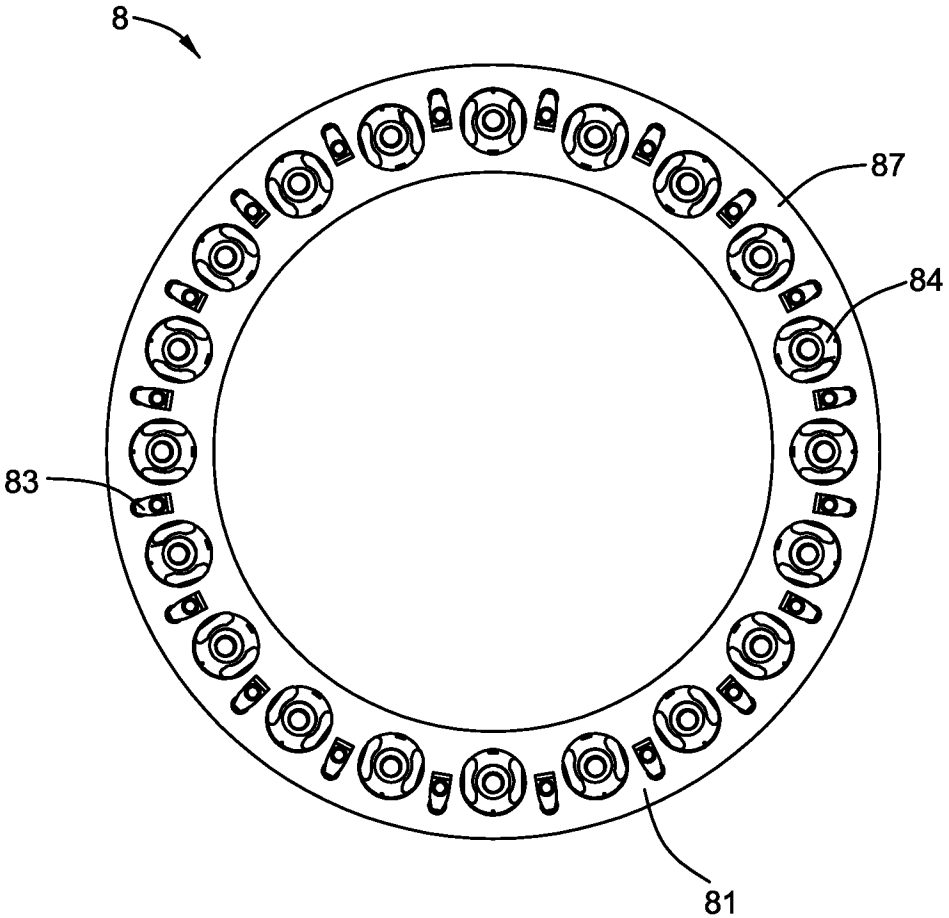
FIG. 9 is a top view of the one-piece deflector of the combustion system in FIG. 8.
Figure 10:
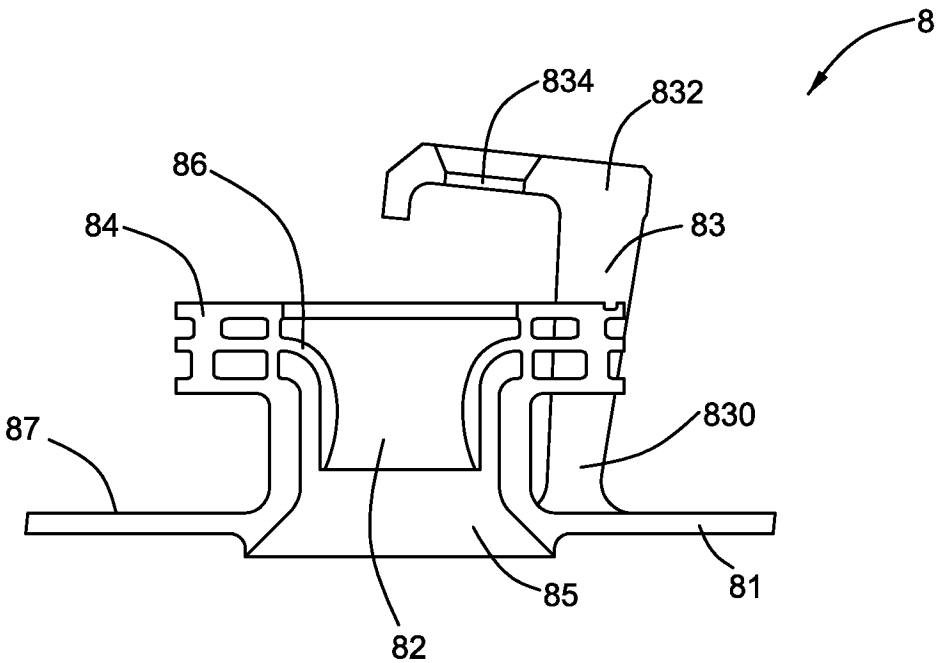
FIG. 10 is a schematic side view illustrating one swirler and one arm looking in a left direction from a dotted line 8-8 of FIG. 8.
Figure 11:
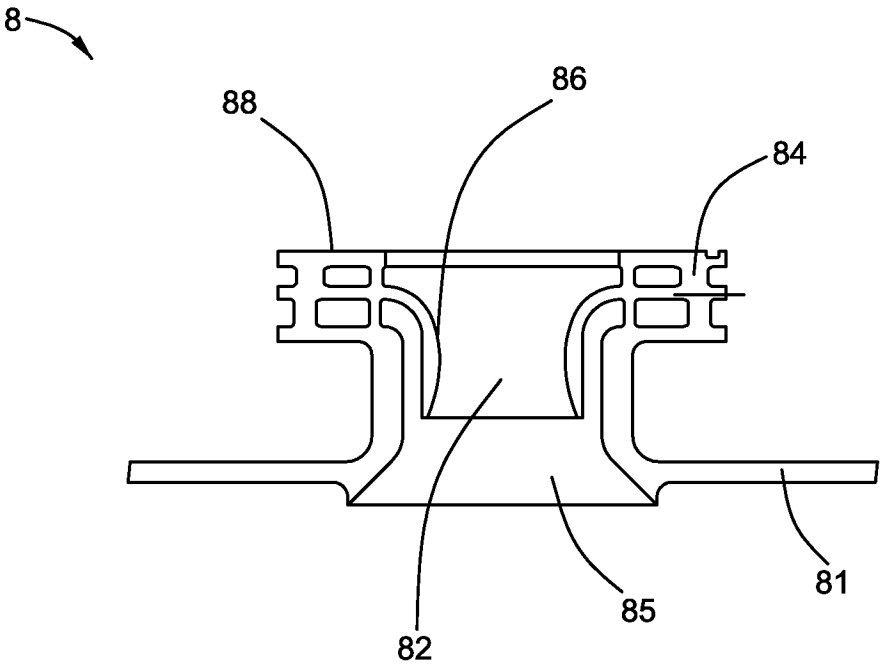
FIG. 11 is a schematic side view of FIG. 10 with the arm removed.

Each swirler 84 extends upward from the surface 87 of the ring body 81 and defines a flare 85 therethrough in the center, with reference to FIGS. 9-10. A venturi 86 extends from a position on an inner wall (not labeled) slightly below a forward surface 88 of the swirler 84. The inner wall defines the flare 85, the venturi 86 extends downwardly within the flare 85 in a direction toward the surface 87 of the ring body 81, and an injection passage 82 is defined in the venturi 86. Optionally, the injection passage 82 and the flare 85 may be coaxial which makes the venturi 86 to be nested within the flare 85. The swirlers 84 may be formed integrally on the surface 87 of the ring body 87 by all possible processes such as additive manufacture like 3D-printing, welding, casting, brazing, etc.

Particularly shown in FIGS. 6-8 and 10, each arm 83 is L-shaped, and has an arm extension 830 extending upward from the surface 87 of the ring body 81 and a mounting face 832 angled from the arm extension 830. The mounting face 832 may be perpendicular to the arm extension 830, or inclined at any suitable angle relative to the arm extension 830. Each arm 83 may be slim and weak, but with all the arms 83 working together, they are sufficient to attach the deflector 8 with the cowl 5 steadily.

A mounting hole 834 is defined in the mounting face 832 for receiving a fastener 50 therethrough. The fastener 50 may be a bolt, nut, screw, or in other forms and is used to couple the arm 83 with the cowl 5. The fasteners/bolts 50 may go through corresponding mounting holes 834 of the arms 83 of the deflector 8 and then through corresponding holes (not labeled) in the dome-like portion 56 of the cowl 5 so as to fasten the deflector 8 with the cowl 5. In this way, the deflector 8 is attached to the cowl via the plurality of arms 83 which are rigid enough to fix the deflector 8 with the cowl 5 while allowing for thermal expansion flexibility therebetween at the same time.

An upstream end of the inner liner 70 and an upstream end of the outer liner 72 are coupled to opposite ends of the cowl 5 respectively via fasteners 52 respectively. Alternatively, the fasteners 52 may be any other suitable fastening means. The opposite ends of the cowl 5 extend respectively from opposite sides of the dome-like portion 56. The ring body 81 of the deflector 8 is traversely positioned between the upstream end of the inner liner 70 and the upstream end of the outer liner 72, while abuts against the opposite ends of the cowl 5 and inner walls of the inner and outer liners 70/72 in the meantime. In other words, the width of the surface 87 (the ring body 81) defines a distance between the upstream end of the inner liner 70 and the upstream end of the outer liner 72. By this way, the dome-like portion 56 of the cowl 5 and the ring body 81 of the deflector 8 enclose an annular chamber (not labeled). The swirlers 84 are located within the annular chamber between the dome-like portion 56 and the ring body 81.

Hence, the inner liner 70, the deflector 8 and the outer liner 72 commonly define the combustion chamber 9. There is a plurality of dilution holes 71 in the inner liner 70 and a plurality of dilution holes 73 in the outer liner which all are set for permitting air coming through from the chamber 22 between the case 20 and the combustor 75 into the combustion chamber 9.

Returning to FIG. 3, the compressed air from the compressor flows through the diffuser 4 in the direction of the arrow A and into the chamber 22. Then, a part of the compressed air enters the annular chamber between the dome-like portion 56 of the cowl 5 and the ring body 81 of the deflector 8 via the apertures 55, where the injection ends 62 of the fuel nozzles 6 go, before flowing into the combustion chamber 9. Some of the part of the compressed air entering the annular chamber between the dome-like portion 56 and the ring body 81 will flow into the flare 85 through a gap (not labeled) between the venturi 86 and the inner walls of the swirlers 84, at the same time, the fuel supplied via the injection ends 62 of the fuel nozzle 6 will pass through the injection passages 82 in the venturi 86 into the flare 85 of the swirlers. Hence, the fuel and the compressed air will meet in the flare 85 and will be pre-mixed to form a fuel-air mixture prior to be released into the combustion chamber 9 from the flare 85. Beside the fuel-air mixture, the compressed air and the fuel, which are not got pre-mixed, may pass through the flare 85 of the swirlers 84 into the combustion chamber 9.

Optionally, about 20% of the compressed air, which enter the combustion chamber 9, flow through the apertures 55 of the cowl 5 and then through the swirlers 84 of the deflector 8 into the combustion chamber 9, while about 80% of the compressed air, which enter into the combustion chamber 9, flow through the dilution holes 71 of the inner liner 70 and the dilution holes 73 of the outer liner 72 into the combustion chamber 9.

Therefore, the combustion system 75 in accordance with the present subject matter is provided to comprise: a cowl 5; a deflector 8 configurated to include a ring body 81, a plurality of swirlers 84 integrated on the ring body 81 and a plurality of arms 83 integrally extending outward from the ring body 81; an annular inner liner 70 attached with the cowl 5; and an annular outer liner 72 attached with the cowl 5. The deflector 8 is positioned between the inner liner 70 and the outer liner 72; the deflector 8, the inner liner 70 and the outer liner 72 define a combustion chamber 9 thereamong. The deflector 8 is attached to the cowl 5 via the plurality of slim and weak arms 83, but the weak arms 83 are rigid enough to work together to fix the deflector 8 with the cowl 5 while allowing for thermal expansion flexibility therebetween at the same time.

The swirlers 84 and the plurality of arms 3 are integrated with the ring body 81 on a same side (surface 87) of the ring body 81. Each of the plurality of arms 83 is L-shaped, and has an arm extension 830 extending from the ring body 81 and a mounting face 832 angled from the arm extension 830. The mounting face 832 defines an aperture 834 for a fastener (e.g., bolt) 50 therethrough to fix the arm 83 with the cowl 5. The deflector 8 is positioned between an upstream end of the inner liner 70 and an upstream end of the outer liner 72. Edges of the ring body 81 of the deflector 8 abut opposite ends of the cowl 5 respectively, as well as inner surface of the upstream end of the inner liner 70 and inner surface of the upstream end of the outer liner 72.

The cowl 5 is annular and has a dome-like cross section, and the cowl 5 is attached to and between the upstream end of the inner line 70 and the upstream end of the outer liner 72. The cowl 5 is fixed to the case 20 of the engine 2 through one or more mounting arm 51. The mounting arm 51 extends forward in an upstream direction for enabling the combustion system 75 to be assembled within the case 20 in a forward mounting way.

A fuel nozzle 6 enters through the cowl 5 and an injection end 62 of the fuel nozzle 6 aligns with a corresponding swirler 84 of the deflector 8 such that corresponding fuel flow into the swirler 84 and an annular chamber between the cowl 5 and the deflector 8 before into the combustion chamber 9. The combustion system 75 further comprises a ferrule 62 for attaining the injection end 62 of the fuel nozzle 6 with the corresponding swirler 84 of the deflector 8.

In sum, the present subject matter provides a combustion system employing a one-piece deflector (dome) with integrally formed swirlers that covers the entire annulus of an annular combustor. The function is to protect related structural components from high combustion gas temperatures and hold the swirlers in place during assembly and operation. The deflector is attached to the cowl via a plurality of relatively weak arms so that it is free to expand as thermal loads driven into the device. The deflector typically has minimal mounting features and is printed as one piece with the swirlers. Additionally, the deflector may have holes printed into the surface that faces the combustor flame.

The assembly/fixing mechanism between the deflector and the cowl of the present subject matter can save an additional dome (compared with the prior arts as above), which is a design simpler, lighter and cost-saving. And more importantly, the weakness of the arms of the deflector can allow or accommodate for thermal expansion while the arms keep the combination of the whole structure stiff enough to withstand vibrational stresses.

Another advantageous technical effect of the present subject matter is that the ring body, the swirlers and the (weak) arms are integrated into the deflector as one single piece, which is simpler, lighter and cost-saving compared with the prior arts with separate ring, swirler or deflectors.

Furthermore, the present subject matter gives a forward mounting structure of the combustion system (combustor) with forwardly extending mounting arms fixed to the engine's case via bolts, which makes the combustor/combustion system having a stronger capability against various vibrations.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A combustion system, comprising:

a cowl;

a deflector comprising a ring body and a plurality of deflector arms integrally extending outward from the ring body, wherein the plurality of deflector arms are circumferentially spaced around the ring body, and wherein each of the plurality of deflector arms is L-shaped and has an arm extension extending from the ring body and a mounting face angled from the arm extension, wherein each mounting face has an aperture therein for a respective fastener therethrough to fix each deflector arm with the cowl, and wherein each mounting face abuts the cowl;

an annular inner liner attached with the cowl; and an annular outer liner attached with the cowl;

2herein the deflector is positioned between the annular inner liner and the annular outer liner; the deflector, the annular inner liner and the annular outer liner define a combustion chamber thereamong; and wherein the plurality of deflector arms are rigid enough to fix the deflector with the cowl while allowing for thermal expansion flexibility between the deflector and the cowl at the same time.

2. The combustion system of claim 1, wherein the deflector further comprises a plurality of swirlers integrally formed with the ring body on a same side of the ring body as the plurality of deflector arms.

3. The combustion system of claim 1, wherein the deflector is positioned between an upstream end of the annular inner liner and an upstream end of the annular outer liner, and wherein edges of the ring body abut a radially inner end of the cowl, a radially outer end of the cowl, an inner surface of the upstream end of the annular inner liner and an inner surface of the upstream end of the annular outer liner.

4. The combustion system of claim 1, wherein the cowl is annular and has a dome shaped cross section, and wherein the cowl is attached to and between an upstream end of the annular inner liner and an upstream end of the annular outer liner.

5. The combustion system of claim 1, wherein the cowl is configured to be fixed to a case of an engine through at least one mounting arm, and the at least one mounting arm extends forward in an upstream direction, the at least one mounting arm being configured to be connected to the case at a position forward of the combustion chamber.

6. The combustion system of claim 1, wherein a fuel nozzle enters through the cowl to engage with the deflector for delivering a fuel flow via the deflector into the combustion chamber.

7. The combustion system of claim 2, wherein a fuel nozzle enters through the cowl and an injection end of the fuel nozzle aligns with a corresponding swirler of the plurality of swirlers of the deflector such that fuel flow from the fuel nozzle enters the swirler before entering the combustion chamber.

8. The combustion system of claim 7, further comprising a ferrule for aligning the injection end of the fuel nozzle with the corresponding swirler of the deflector.

9. A combustion system, comprising:

a cowl;

a deflector comprising a ring body, a plurality of swirlers and a plurality of deflector arms, wherein the plurality of deflector arms are circumferentially spaced around the ring body, and wherein each of the plurality of deflector arms is L-shaped and has an arm extension extending from the ring body and a mounting face angled from the arm extension, wherein each mounting face has an aperture therein for a respective fastener therethrough to fix each deflector arm with the cowl, and wherein each mounting face abuts the cowl;

an annular inner liner attached with the cowl; and an annular outer liner attached with the cowl;

2herein the plurality of swirlers and the plurality of deflector arms are integrally formed with the ring body to form a unitary structure, and the deflector is positioned between the annular inner liner and the annular outer liner thereby defining a combustion chamber thereamong.

10. The combustion system of claim 9, wherein the plurality of swirlers are integrated with the ring body on a same side of the ring body as the plurality of deflector arms.

11. The combustion system of claim 9, wherein the deflector is positioned between an upstream end of the annular inner liner and an upstream end of the annular outer liner, and wherein edges of the ring body abut the inner surface of the upstream end of the annular inner liner, the inner surface of the upstream end of the annular outer liner, and end wall of the cowl.

12. The combustion system of claim 9, wherein the cowl is annular and has a dome shaped cross section, and wherein the cowl is attached to and between an upstream end of the annular inner liner and an upstream end of the annular outer liner.

13. The combustion system of claim 9, wherein the cowl is configured to be fixed to a case of an engine through at least one mounting arm, and the at least one mounting arm extends forward in an upstream direction, the at least one mounting arm being configured to be connected to the case at a position forward of the combustion chamber.

14. The combustion system of claim 9, wherein a fuel nozzle enters through the cowl and an end of the fuel nozzle engages with a corresponding swirler of the deflector for delivering a fuel flow via the deflector into the combustion chamber.

15. An engine system, comprising:

a case;

a fuel nozzle; and a combustor assembly comprising:

An annular cowl;

A deflector comprising a ring body and a plurality of deflector arms integrally extending outward from the ring body, wherein the plurality of deflector arms are circumferentially spaced around the ring body, and wherein each of the plurality of deflector arms is L-shaped and has an arm extension extending from the ring body and a mounting face angled from the arm extension, wherein each mounting face has an aperture therein for a respective fastener therethrough to fix each deflector arm with the annular cowl, and wherein each mounting face abuts the cowl;

an annular inner liner attached with the annular cowl; and an annular outer liner attached with the annular cowl;

wherein the deflector is positioned between the annular inner liner and the annular outer liner; the deflector, the annular inner liner and the annular outer liner define a combustion chamber thereamong; and wherein the plurality of deflector arms are rigid enough to fix the deflector with the annular cowl while allowing for thermal expansion flexibility between the deflector and the cowl at the same time.

16. The engine system of claim 15, wherein the deflector further comprises a plurality of swirlers integrated with the ring body on a same side of the ring body as the plurality of deflector arms.

17. The engine system of claim 15, wherein the annular cowl has a dome shaped cross section and is attached to and between an upstream end of the annular inner liner and an upstream end of the annular outer liner, and wherein the annular cowl is fixed to the case by at least one mounting arm extending forward in an upstream direction, the at least one mounting arm being connected to the case at a position forward of the combustor assembly.

* * * * *